United States Patent [19]

Gartner et al.

[11] Patent Number: 5,033,282

[45] **Date of Patent: * Jul. 23, 1991**

[54] SELF-LOCKING ELECTRONIC LOCK

[75] Inventors: Klaus W. Gartner, Palos Verdes Estates; Alan K. Uyeda, Pico Rivera; Peter J. Phillips, Long Beach, all of Calif.

[73] Assignee: LA Gard, Inc., Torrance, Calif.

[ * ] Notice: The portion of the term of this patent subsequent to May 22, 2007 has been disclaimed.

[21] Appl. No.: 533,896

[22] Filed: Jun. 6, 1990

Related U.S. Application Data

[63] Continuation-in-part of Ser. No. 311,696, Feb. 16, 1989, Pat. No. 4,926,664.

[51] Int. Cl.[5] ..... E05B 49/00

[52] U.S. Cl. ..... 70/278; 70/119

[58] Field of Search ..... 70/277, 278, 279, 280, 70/281, 282; 292/169.12

[56] References Cited

U.S. PATENT DOCUMENTS

| | | | |
|---|---|---|---|
| 2,823,536 | 2/1958 | Watson . | |
| 3,702,070 | 11/1972 | Gartner . | |
| 3,758,734 | 9/1973 | Gartner . | |
| 4,148,092 | 4/1979 | Martin . | |
| 4,457,148 | 7/1984 | Johansson et al. . | |
| 4,496,178 | 1/1985 | Best | 292/169.13 |
| 4,665,727 | 5/1987 | Uyeda . | |
| 4,714,030 | 12/1987 | Cole . | |
| 4,745,784 | 5/1988 | Gartner . | |
| 4,899,562 | 2/1990 | Gartner et al. . | |
| 4,904,984 | 2/1990 | Gartner et al. . | |
| 4,926,664 | 5/1990 | Gartner | 70/119 |

*Primary Examiner*—Robert L. Wolfe

*Attorney, Agent, or Firm*—Poms, Smith, Lande & Rose

[57] ABSTRACT

A self-locking electronic lock system is illustrated in association with safe doors having a door locking bolt works manipulated between door open and door locked positions by a door mounted handle. The bolt works includes a link which moves the door bolts and in turn is locked by an electronic lock in accordance with the present disclosure. The elctronic lock has a spring bias bolt normally biased into a locking gate provided on the link and is operated to a withdrawn position by an associated digital input electronic signal generating means. A lost motion connection is provided between an electric motor of the lock and the lock bolt such that the motor withdraws the lock bolt on entry of a correct combination to the digital input means and the lock bolt is biased back into locking engagement with the link gate by operation of an operator closing the safe door and manipulating the door handle to throw the door bolts into engagement with the safe door jamb, the electronic lock bolt automatically locking up with the bolt works link to prevent reopening of the door until the combination is entered again due to the bias of the lock bolt toward the link gate.

25 Claims, 8 Drawing Sheets

Fig. 14.
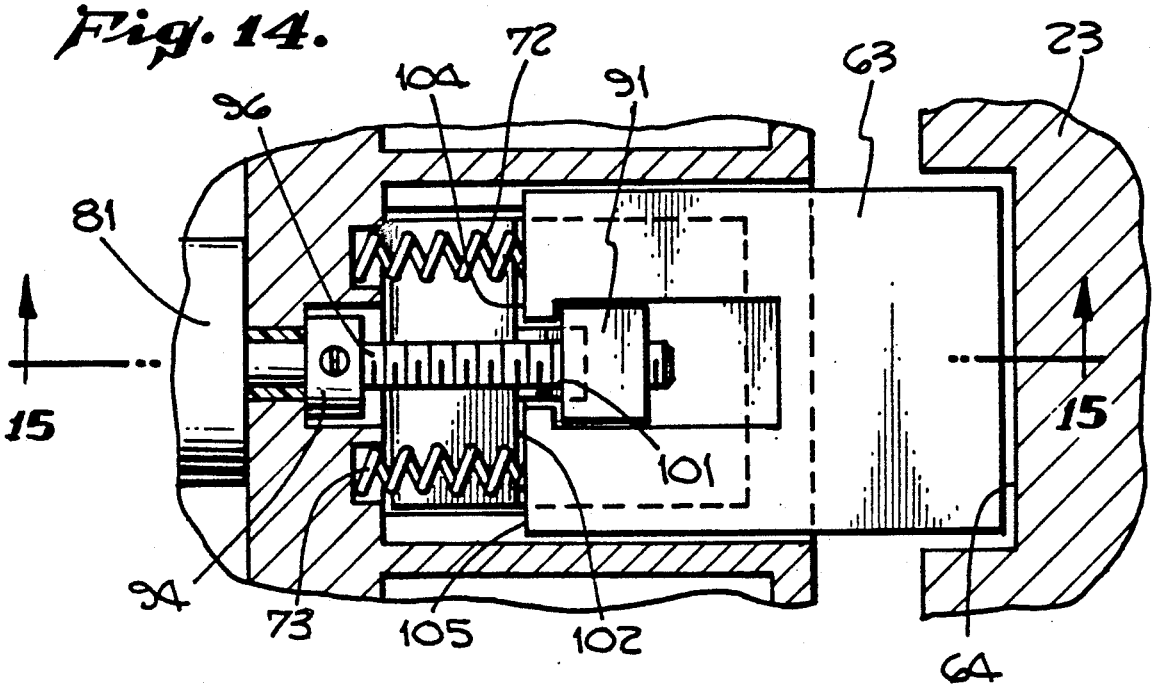
Fig. 15.
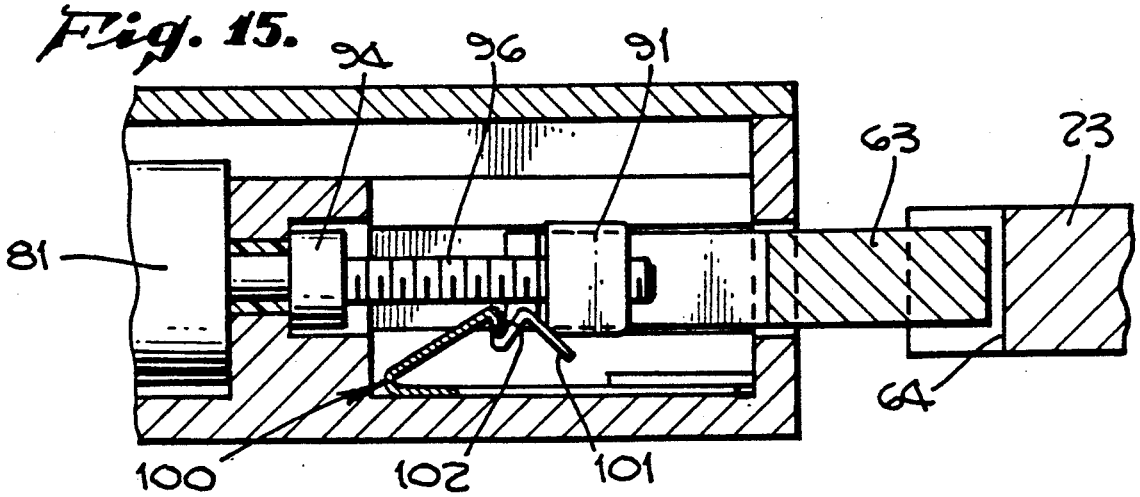
Fig. 17.
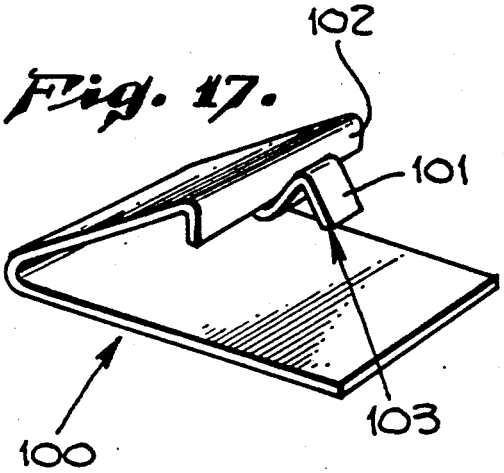
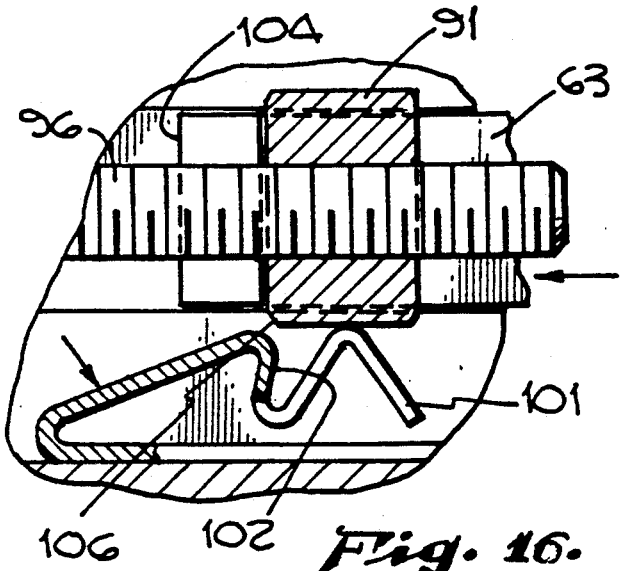
Fig. 16.

Fig. 18.
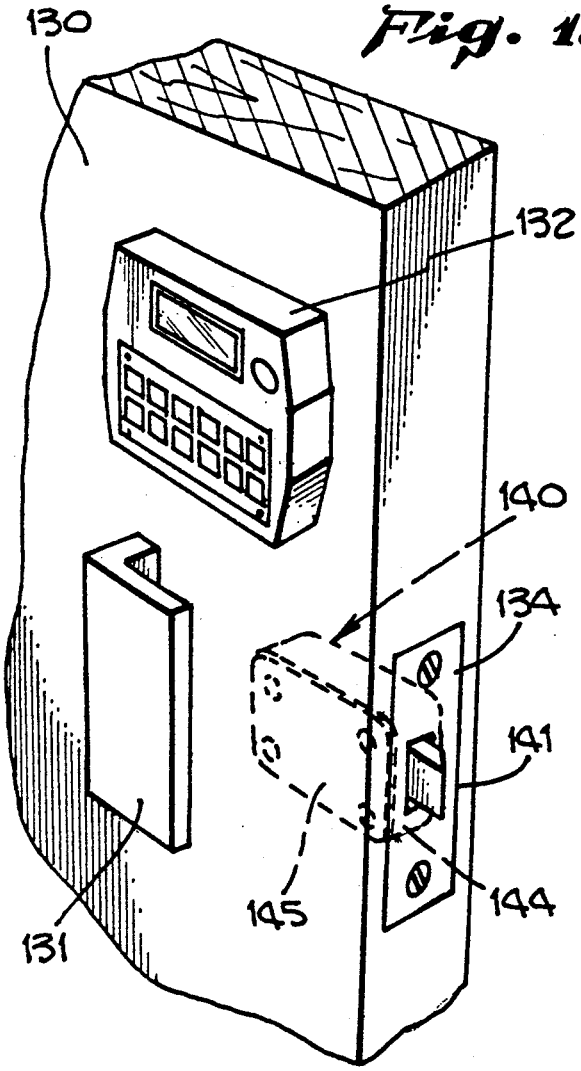
Fig. 20.
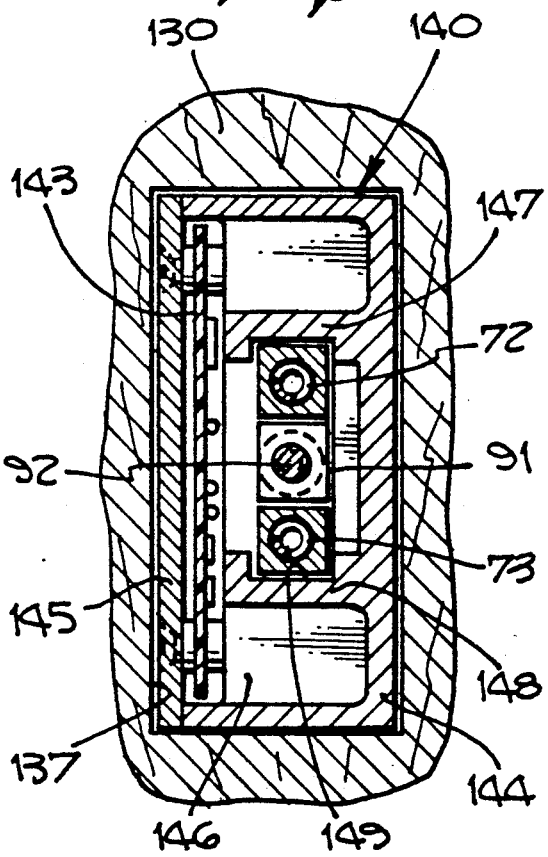
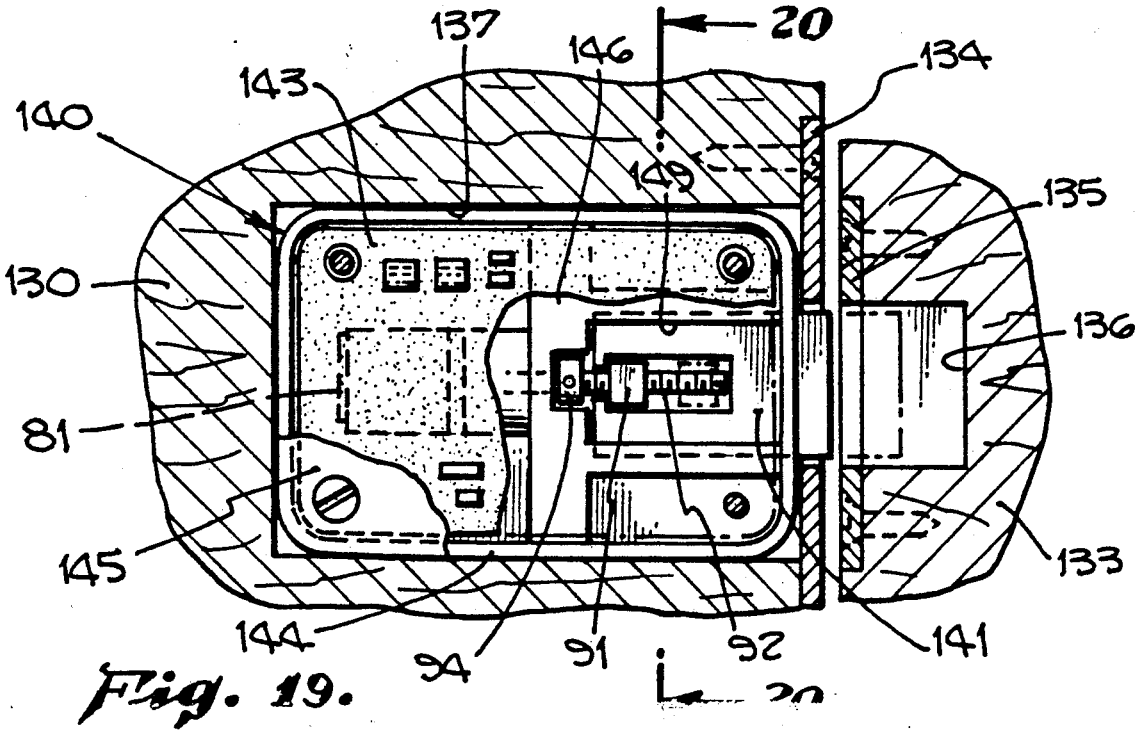
Fig. 19.

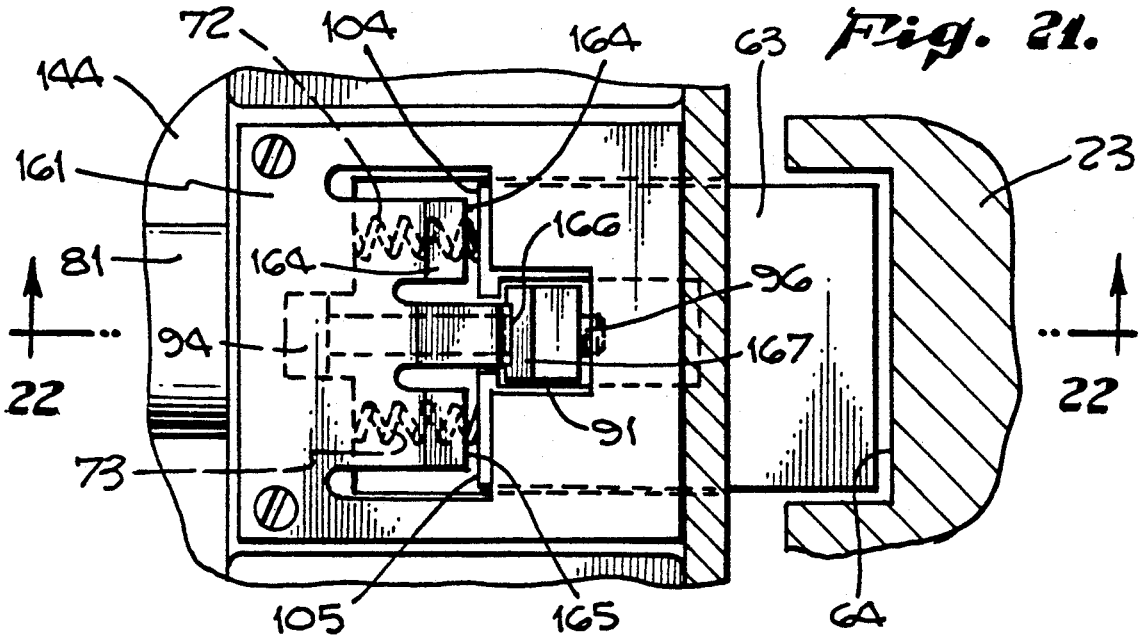
Fig. 21.
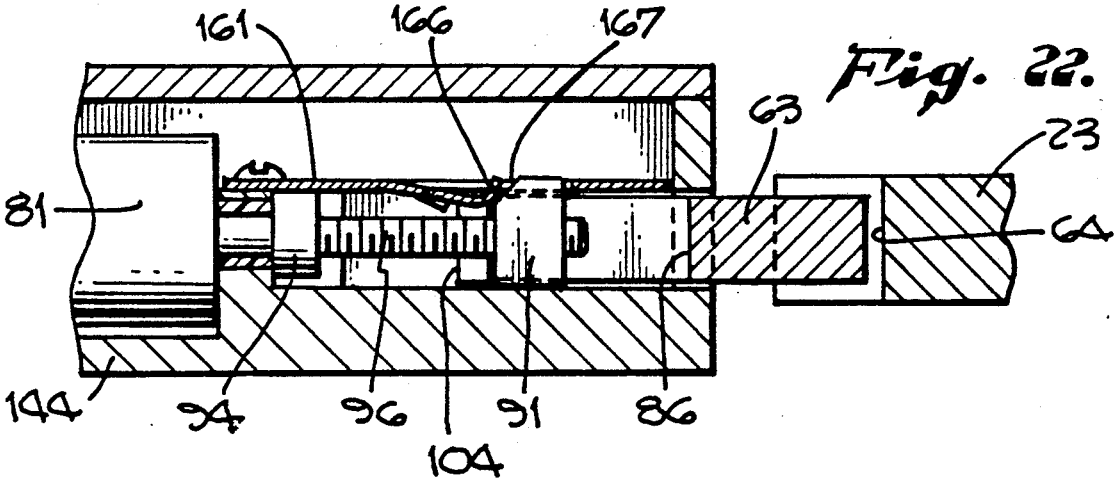
Fig. 22.
Fig. 23.
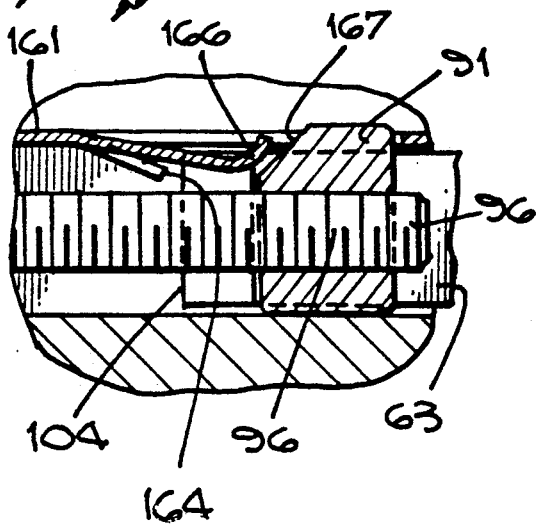
Fig. 24.
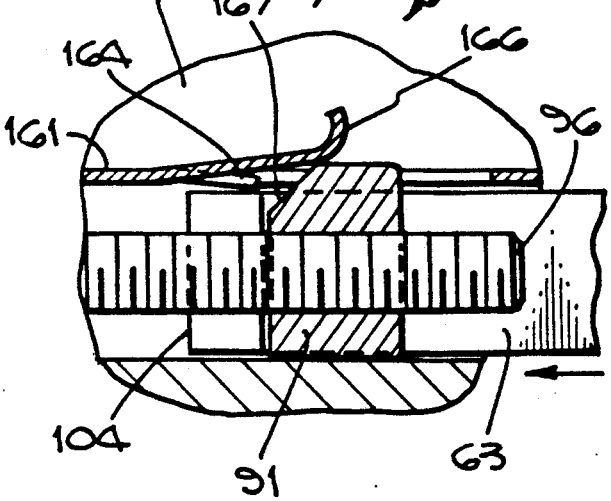

SELF-LOCKING ELECTRONIC LOCK

RELATED APPLICATIONS

This application is a continuation-in-part application based upon applicant's copending application Ser. No. 07/311,696, filed Feb. 16, 1989, U.S. Pat. No. 4,926,664 and entitled "SELF LOCKING ELECTRONIC LOCK."

INTRODUCTION

Generally stated, the present invention relates to electrically operated locks for safe doors and the like, and more particularly to an automatically self-locking electronic lock system for use with safe doors having manually operated bolt works.

BACKGROUND OF THE INVENTION

Various types of electrical locks for safe doors and the like have been developed heretofore as shown in prior patents to one of the inventors herein, Klaus W. Gartner, including U.S. Pat. Nos. 3,702,070; 3,758,734; and 4,745,784. These patents show various types of electrical input means for operating an electrical lock for locking a safe door or the like. Another electronic combination door lock which senses the position of an associated dead bolt operated by the electrical means is illustrated in U.S. Pat. No. 4,148,092.

In these prior exemplary electronic lock mechanisms, and in other known prior electronic lock mechanisms, the associated locking mechanisms have not been automatically self-locking. Specifically, in the case of a safe door which has a manually operated bolt works thrown between door locking and unlocking conditions by the turning of a door handle, the door can be closed with the door handle in an apparent bolt locking position, easily visible to an observer thereof, but the associated lock mechanism may or may not be locked depending upon whether the associated dial mechanism or electronic lock mechanism also has been adjusted to a locking mode or condition. In certain commercial utilizations, employees handling money during the working day may prefer not to have to manipulate an electronic or combination lock to open and close the safe and simply throw the bolt works of the door into a locked condition when the safe door is closed, the door then appearing to be in a locked condition, even though it is not.

SUMMARY OF THE INVENTION

In view of the foregoing, it is a primary object of the present invention to disclose and provide an automatically self-locking electronic lock for safe doors and the like, wherein the closing of the safe door and manipulation of the associated bolt works provides an automatic locking of the associated electronic locking mechanism so that the door will be fully locked when closed and an associated handle is in a door bolt works locking position. It is a further object of the present invention to disclose and provide such an electrically operating door mechanism which is easily manufactured, simply operated and easily assembled into pre-existing bolt works of known construction for pre-existing, as well as newly constructed, safe doors.

Generally stated, the present invention is a self-locking electronic lock for use with a safe door having manually operated bolt works, wherein the bolt works includes a door handle on the outside of the door and a linkage on the inside of the door operated by such handle, and the provision of a lock mechanism having a lock bolt normally biased into a linkage engaging and locking position together with a mounting means for mounting such lock bolt relative to the linkage so that the bolt is normally biased into a linkage locking position. Electronically driven means are provided in accordance with the present invention for withdrawing the lock bolt against its bias from a locking engagement with the bolt works linkage to allow manipulation of the linkage by the safe door handle to release the bolt works and open the door. Specifically, the present invention contemplates the provision of a lost motion connection between the lock bolt and the electrically driven means whereby after opening of the safe door, the electrically driven means can be reversed, through the lost motion connection with the lock bolt, to release the lock bolt which can then simply abut a portion of the linkage adjacent a linkage gate which the lock bolt enters to lock the linkage. A reversible lock for operating an associated follower block which rides within a slot provided within the lock bolt to accomplish the aforementioned bolt withdraw and release movements. An electrical signal for operating the electrical motor is preferably generated by an electronic combination input means with the motor being first driven in a direction to withdraw the lock bolt, then be operated in a dwell mode during which the door bolts may be swung to an unlock condition through manipulation of the linkage and then in a bolt release motion whereby the bolt is released from its electrical drive. On manual manipulation of the bolt works linkage to throw the door bolts back into a door locking condition, the biased lock bolt rides along a portion of the linkage adjacent the link gate and automatically snaps into such link gate to lock the linkage against reopening of the safe door until the predetermined combination is entered once again through the code input means to generate a lock opening signal to the electrical motor associated with the lock bolt.

Additionally, the present invention includes a blocking means for the prevention of unauthorized withdrawal of the lock bolt from its normally biased position, and a releasing means to enable authorized withdrawal of the lock bolt. The blocking means consists of a leaf spring having a stop surface to contact and block withdrawal of the bolt. The releasing means consists of an engagement surface integral to the leaf spring to engage the lost motion connection and deflect the stop surface from the lock bolt blocking position on operation of the lost motion connection to enable retraction of the lock bolt.

Alternatively, the present invention also provides a self locking electronic lock for use in a human passage security door, wherein the electrically driven means are provided for withdrawing the lock bolt against its bias from engagement within the door jamb, in response to entry of a predetermined code via a code entry means mounted on the front of the door. Specifically, the present invention contemplates the provision of a lost motion connection between the lock bolt and the electrically driven means whereby after opening the security door, the electrically driven means can be reversed, through the lost motion connection with the lock bolt, to release the lock bolt to its normally biased position. On closing the security door, the lock bolt deflects inward against its bias upon contact with the door jamb, then returns to its normally biased position when the security door is fully closed.

It is believed that a more complete understanding of the present invention, as well as the appreciation of additional objects and advantages thereof, will be afforded to those skilled in the art from a consideration of the following detailed description of a preferred exemplary embodiment thereof. Reference will be made to the appended sheets of drawings which will first be briefly described.

BRIEF DESCRIPTION OF THE DRAWINGS

FIG. 14 is a rear view of the preferred exemplary embodiment of self locking electronic lock, the lock bolt in the normal locked position in the gate in the bolt works linkage, showing the stop surface of the blocking means in position to prevent unauthorized withdrawal of the lock bolt.

FIG. 15 is a transverse section view through the preferred exemplary embodiment of self locking electronic lock of FIG. 14 taken therein along the plane 15—15.

FIG. 16 is a similar view as in FIG. 15 showing the engagement surface of the releasing means engaging the slide block as the lock bolt is withdrawn by the associated motor means, deflecting the stop surface.

FIG. 17 is a perspective view of an exemplary embodiment of the leaf spring blocking and releasing means.

FIG. 18 is a front elevational view of an exemplary human passage door having a fixed handle and an exemplary electronic lock combination entry push pad and a spring biased cam bolt lock.

FIG. 19 is a rear elevational view of the preferred exemplary embodiment of the self locking electronic lock with the lock housing cover partially removed, the lock bolt being withdrawn by the associated motor means.

FIG. 20 is a vertical section view through the preferred exemplary embodiment of self locking electronic lock of FIG. 19 taken along the plane 20—20.

FIG. 21 is a rear view of the preferred exemplary embodiment of the selflocking electronic lock, the lock bolt in the normal locked position in the gate in the bolt works linkage, showing the left and right tongues of the alternative embodiment of the blocking means in position to prevent unauthorized withdrawal of the lock bolt.

FIG. 22 is a vertical section view of an exemplary embodiment of the selflocking electronic lock of FIG. 21 through the plane 22—22.

FIG. 23 is an enlarged detail view as in FIG. 22 showing the alternative embodiment of the blocking means in the position normally biased to prevent inward motion of the bolt.

FIG. 24 is an enlarged view as in FIG. 23 showing the alternative embodiment of the blocking means in the deflected position enabling inward motion of the bolt.

DETAILED DESCRIPTION OF A PREFERRED EXEMPLARY EMBODIMENT

Figure 1:
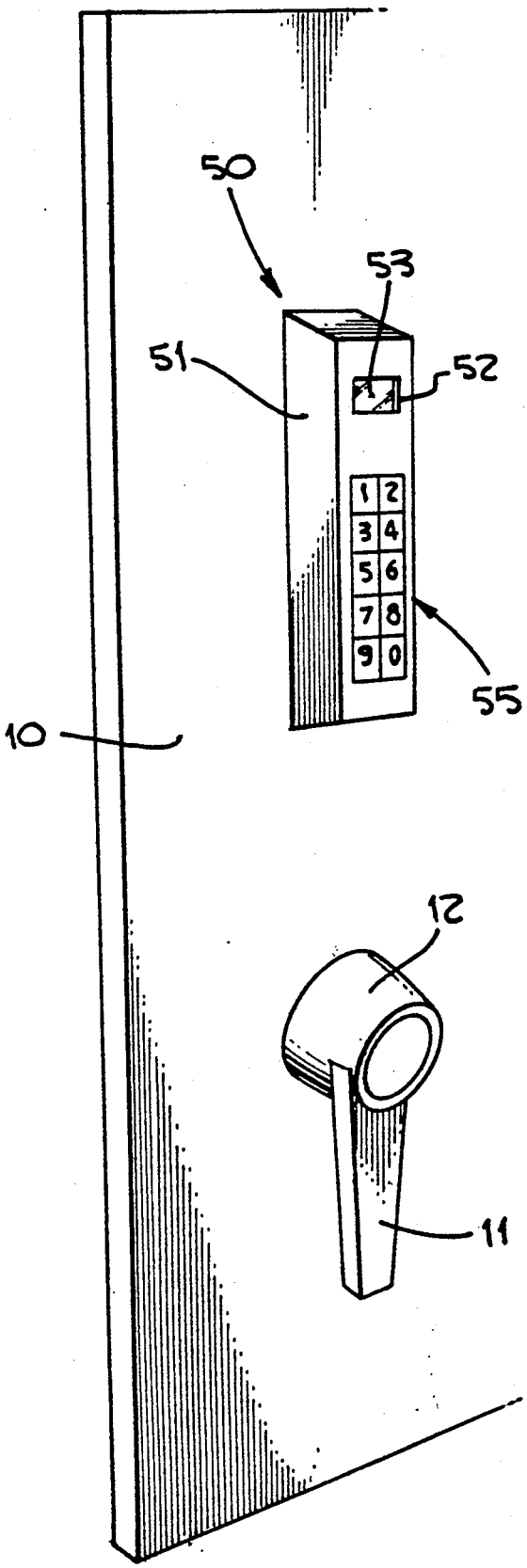
FIG. 1 is a front elevational view of an exemplary safe door having a manually operable handle associated with bolt works on the rear side of the door and an exemplary electronic lock combination entry push pad and circuit board means for generating a lock opening signal when a predetermined combination of push pad manipulations are accomplished.
Figure 2:
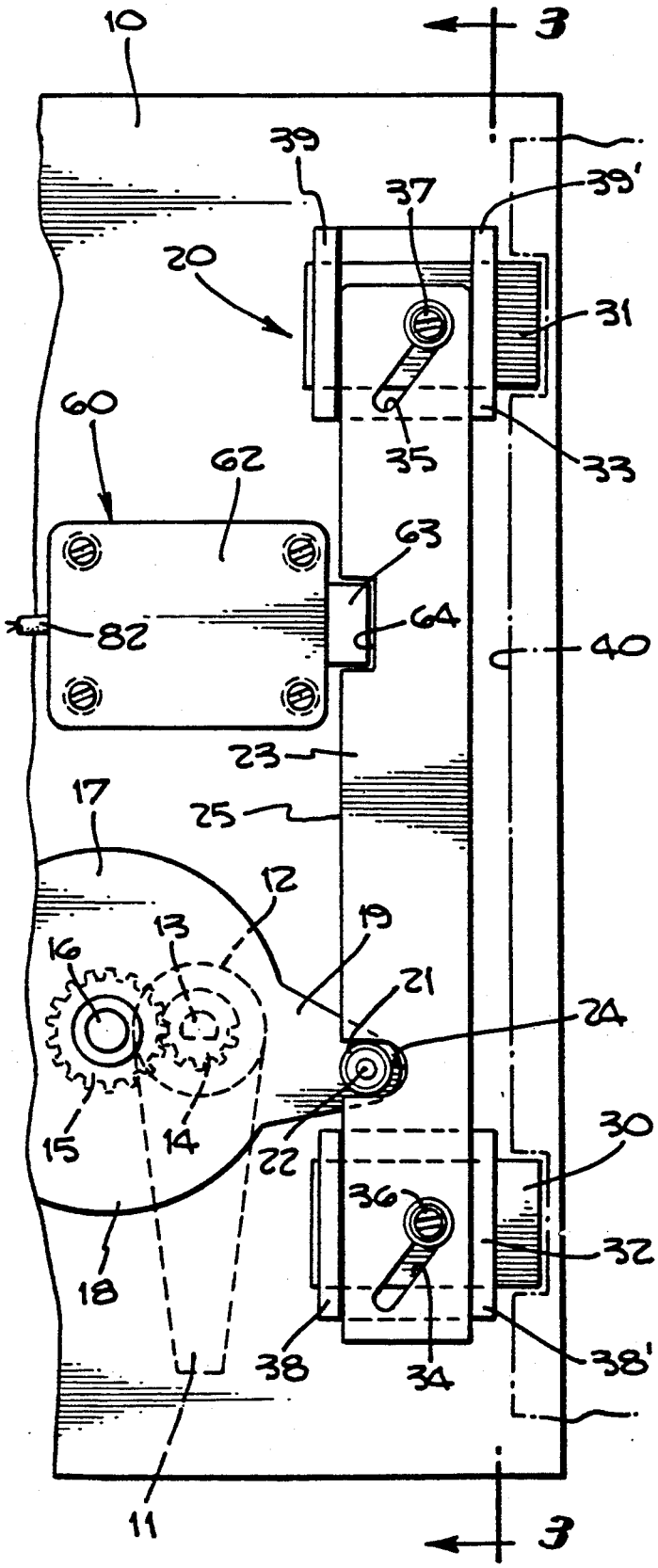
FIG. 2 is a rear view of the safe door of FIG. 1 showing an exemplary embodiment of bolt works shown in a door locking condition and being held in such locked condition by the preferred exemplary embodiment of the self-locking electronic lock in accordance with the present invention.
Figure 3:
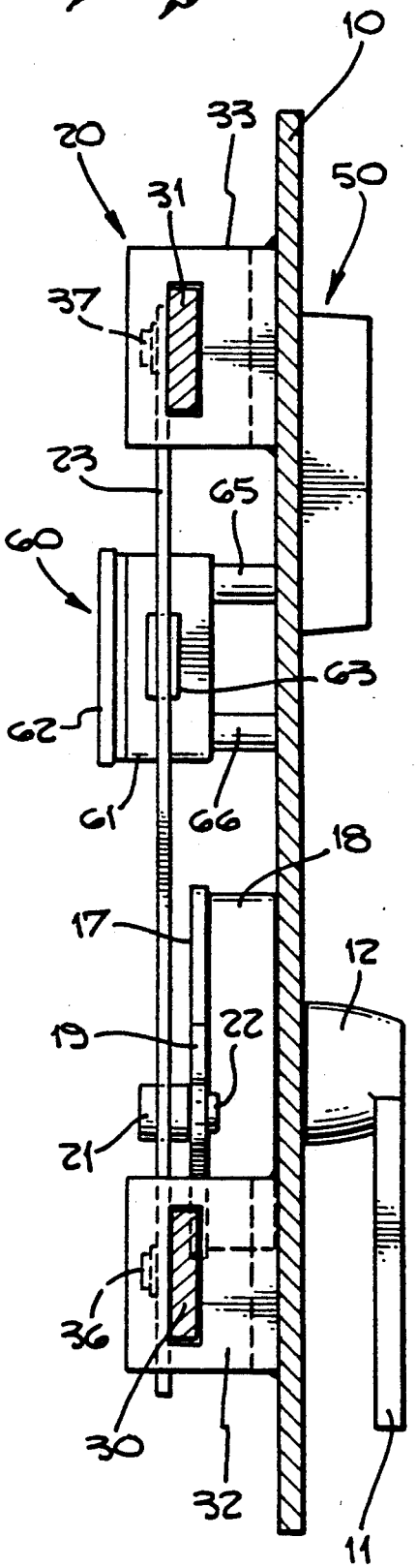
FIG. 3 is a vertical section view through the safe door and bolt works of FIG. 2 taken therein along the plane 3—3.
Figure 4:
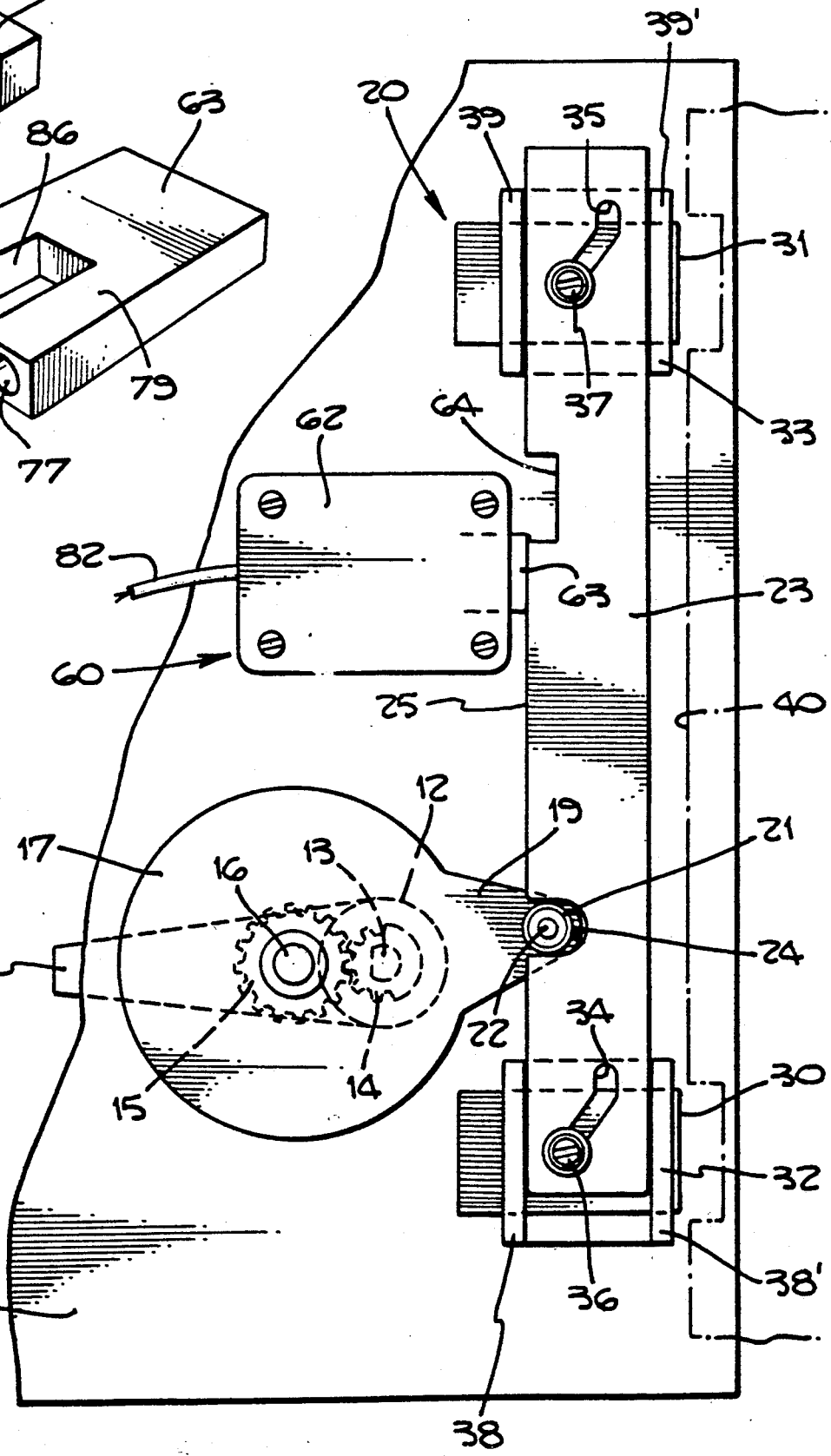
FIG. 4 is a view as in FIG. 2, showing the safe door bolt works in a door unlocking condition and with the self-locking electronic lock of the present invention shown with its lock bolt engaging against an end surface of the vertical link of the exemplary bolt works.

Referring initially to FIGS. 1 through 3, an exemplary safe door 10 is illustrated as having a manually operable handle 11 on the outer front side of the door and a door locking bolt works, indicated generally at 20, provided on an inner rear side of the door as seen in FIGS. 2 and 3. Door handle 11 includes an integral handle boss 12 which is secured to handle shaft 13 which passes through an appropriate journal surface provided through the door. On the inner side of the door 10, shaft 13 is provided with a drive gear 14, mounted on an inner end of shaft 13 as seen in FIGS. 2 and 4, so that gear 14 rotates with manual rotation of handle 11 as seen in FIGS. 2 and 4. Drive gear 14 meshes with a driven gear 15 which in turn is fixed by a mounting journal 16 secured to the wall 17 of driven shell 18. An extension 19 is provided on wall 17 to mount the roller 21 via a mounting pin 22 to allow manipulation of the bolt works indicated generally at 20.

In the exemplary embodiment, the bolt works indicated generally at 20 includes the provision of linkage including the vertical link 23, having roller slot 24, whereby manipulation of handle 11 in a clockwise direction, as viewed in FIG. 1, shifts the link 23 upwardly as seen in comparison in FIGS. 2 and 4, the link having been raised in FIG. 4. Door bolts 30 and 31 are mounted in mounting journal blocks 32 and 33 to the rear of door 10, as by welding, so that the bolts 30 and 31 are movable between their outer door locking position of FIG. 2 and the inner door release position of FIG. 4. The bolts are manipulated through such movement by link 23 through the inclined slot and follower pin connections provided by the incline slots 34 and 35 on link 23 and the follower pins 36 and 37 provided on blocks 30 and 31, respectively. As shown in FIG. 2, link 23 slides between the end plates 38, 38' and 39, 39' of the mounting blocks 32 and 33 during its vertical movement from the position of FIG. 2 to that of FIG. 4, to cause a withdrawal of the door bolts 30 and 31 when the door handle is turned a quater turn in the clockwise direction of FIG. 1. As in phantom line in FIGS. 2 and 4, door bolts 30 and 31 are adapted to fit within appropriate bolt receptacles in the door jamb 40.

Figure 13:
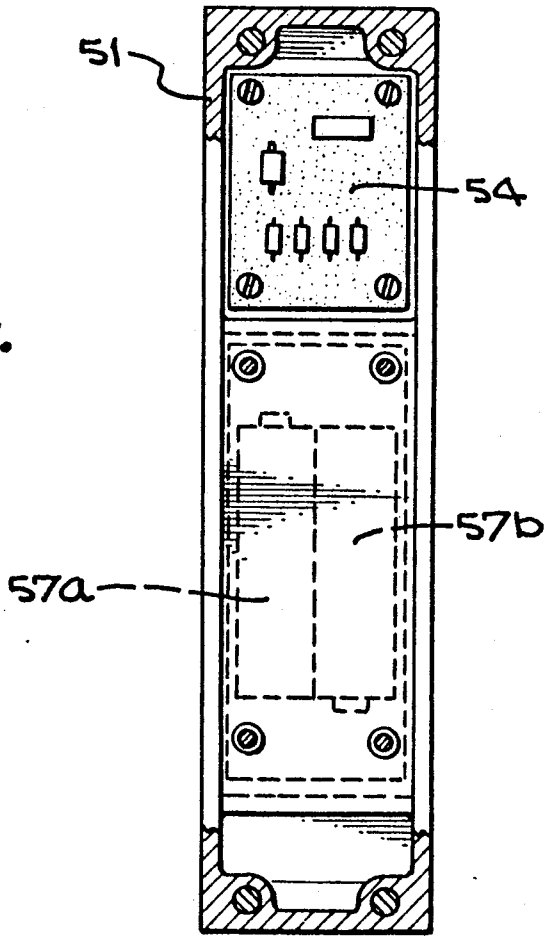
FIG. 13 is a rear view of the digital input means and signal generating means taken along 13—13 of FIG. 11.
Figure 11:
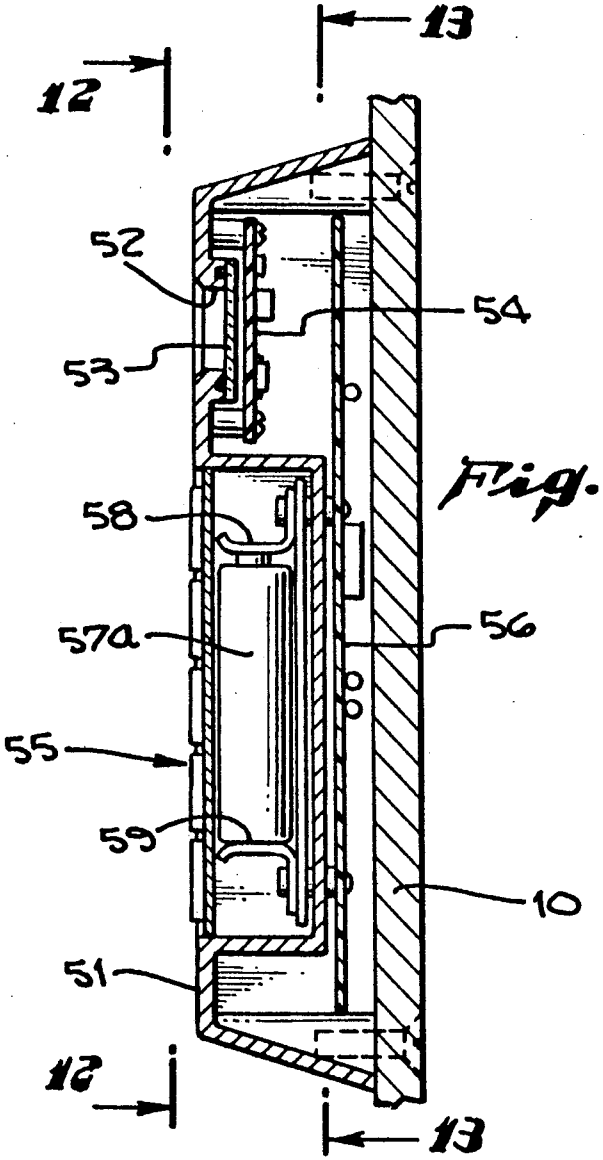
FIG. 11 is a vertical section view through an exemplary embodiment of electronic code digital input means and signal generating means.
Figure 12:
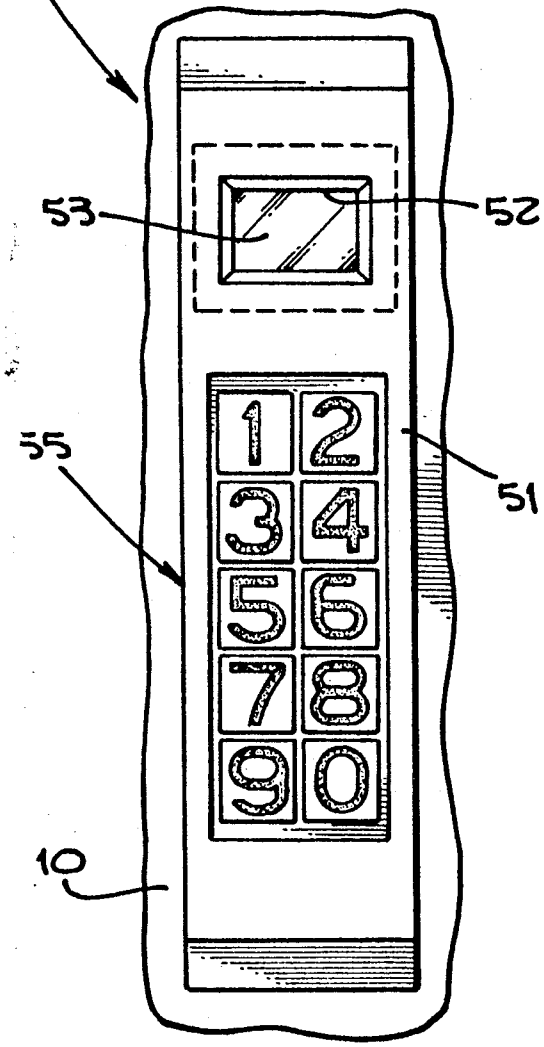
FIG. 12 is a front view of the digital input means and signal generating means taken along 12—12 of FIG. 11.

Referring once again to FIG. 1, an exemplary embodiment of an electronic code input means is indicated generally at 50. Such electronic code input means are already well known in the art of electronic locks as in part disclosed in prior patents, U.S. Pat. Nos. 4,745,784; 4,148,092, and application for U.S. Letters Patent entitled "ELECTRONIC DOOR LOCK," Ser. No. 07/193,520, filed May 11, 1988, the disclosures of which are incorporated herein by this reference. The exemplary input means include, in general, a housing or face plate 51 secured to the front side of the safe door 10 as seen in FIG. 1, and associated electronic circuitry within the housing and face plate as seen in FIGS. 11 to 13. In the exemplary electronic code input means, indicated generally at 50, the face plate 51 has a viewing aperture 52 with a transparent window 53 which is positioned directly in front of a liquid crystal display means 54 for displaying a numeral corresponding to the individual one of the push pads, indicated generally at 55, depressed by the individual attempting to enter the safe door. The individual code, whether it be numeric or alphabetic, is recorded as a sequence of input signals by the printed circuit board 56. The push button means, liquid crystal display unit and circuit board are powered by a self-contained power source such as the batteries 56*a* and 56*b* which are held within face plate 51 by the two spring retainer electrical connectors 58 and 59, as seen in FIG. 11. As is known in the art, when a predetermined sequence of codes is entered via the push pads 55, the circuit board 56 recognizes the correct combination and puts out a lock opening signal to the associated lock means.

Figure 6:
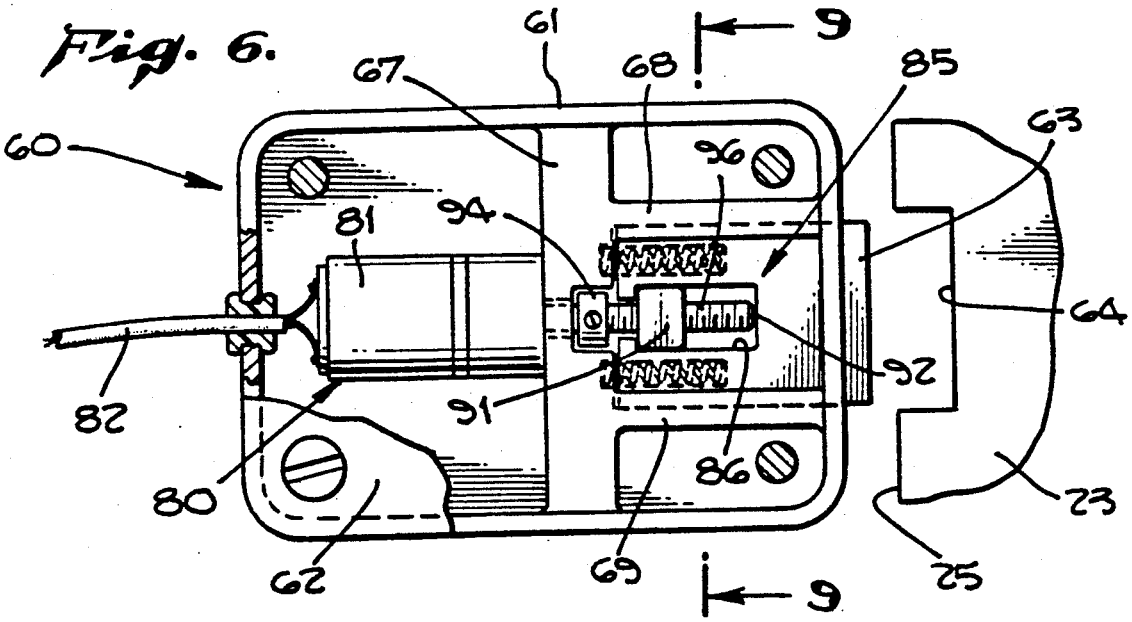
FIG. 6 is a rear elevational view, with the lock housing cover partially removed, showing the preferred exemplary embodiment of a self-locking electronic lock in accordance with the present invention, the lock bolt being withdrawn by the associated motor means to release the associated bolt works linkage.

As is particularly contemplated within the present invention, the electronic lock of the present invention is self-locking when the safe door is closed and the bolt mechanism is returned to the door bolt locking position of FIG. 2. In the exemplary embodiment, such self-locking electronic lock is indicated generally at 60 in FIGS. 1–4 and 6–8, and includes a lock housing 61, as seen in FIGS. 3 and 6, normally enclosed by a cover plate 62, as seen in FIGS. 2–4. The lock bolt 63 is adapted to fit within gate 64 of link 23 when the electronic lock, indicated generally at 60, is in a bolt works locking condition as seen in FIG. 2. Lock housing 61 may be mounted by appropriate mounting bolts 65 and 66 to the interior of safe door 10 as seen in FIG. 3 to position lock bolt 63 in alignment with gate 64 to be normally in engagement therewith when the lock bolts are in their locking position, as seen in FIGS. 2 and 3.

Figure 9:
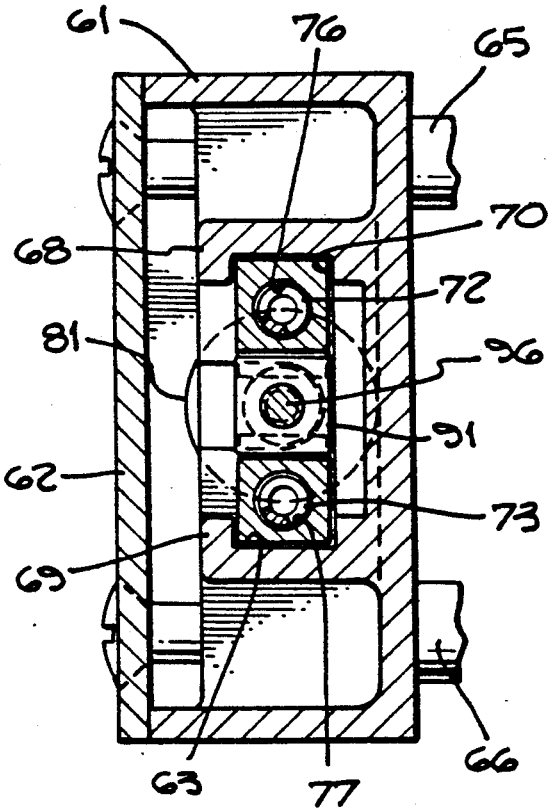
FIG. 9 is a vertical section view through the preferred exemplary embodiment of a self-locking electronic lock of FIG. 6 taken therein along the plane 9—9.
Figure 7:
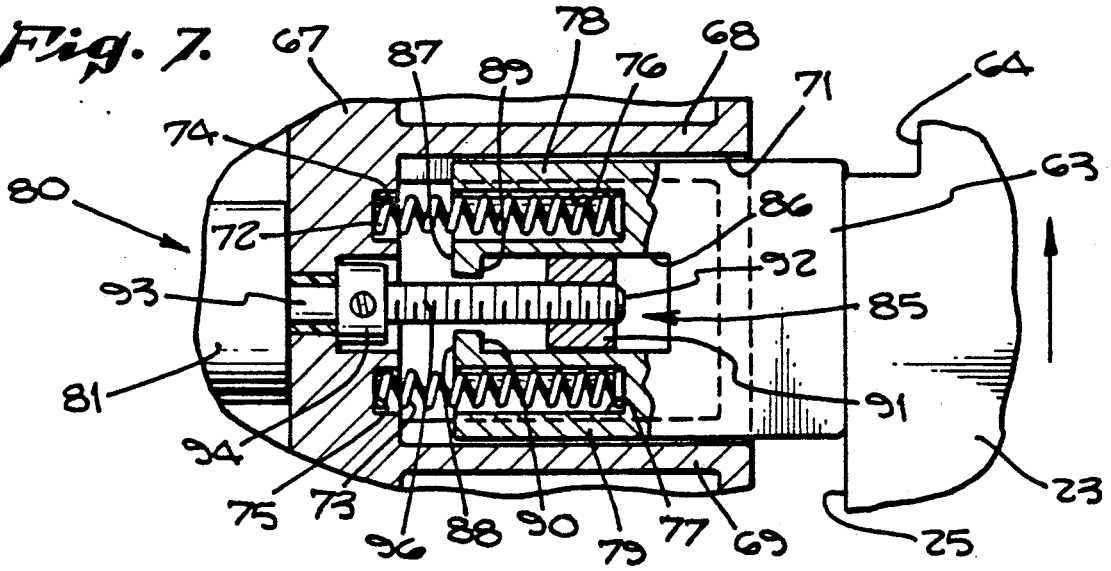
FIG. 7 is a view as in FIG. 6 showing the lock bolt released by the lost motion connection between the lock bolt and the electric motor means with the lock bolt abutting the associated lock bolt works linkage under the bias of its associated spring means.
Figure 8:
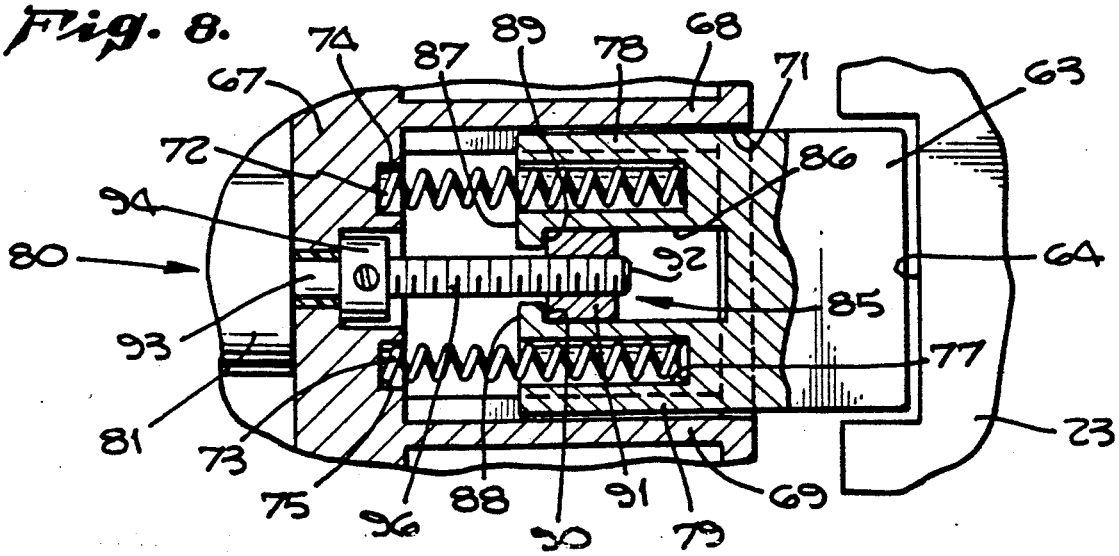
FIG. 8 is a view as in FIG. 7 showing the lock bolt having automatically entered a gate in the bolt works linkage when the vertical link has been shifted vertically relative the lock bolt as seen in FIGS. 7 and 8 as is accomplished in the present exemplary embodiment when the safe door is closed and the door handle is moved to throw the safe door bolts into door locking position.

Referring now more specifically to FIGS. 6 through 9, the exemplary electronic lock housing 61 is provided with a central web 67 which is integral with webs 68 and 69 which, together with a base wall 70 as best seen in FIG. 9, provide a slide way 71 for bolt 63. Bolt 63 is biased by spring means to normally extend outwardly of slide way 71 and housing 61, as seen in FIG. 8. Such spring means in the exemplary embodiment include the coil springs 72 and 73, which sit in mounting bores 74 and 75 in web 67, as seen in FIGS. 7 and 8, and fit within spring receiving bores 76 and 77 formed within the leg 78 and 79 of bolt 63. As seen in FIG. 7, such outward bias for bolt 63 causes it to rest against an inner edge surface 25 of link 23.

Figure 10:
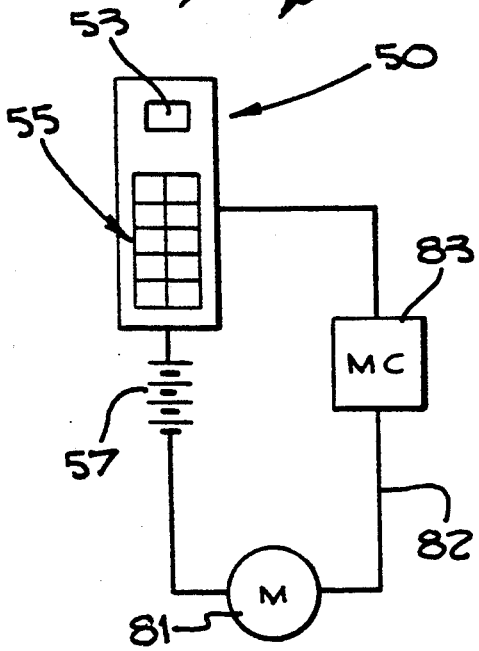
FIG. 10 is a simplified schematic of an exemplary circuit for operating the reversible motor of the electronic lock of the present invention.

Electrically driven means are provided in the exemplary embodiment for withdrawing the lock bolt 63 against its bias of springs 72 and 73 from the gate 64 on actuation thereof in response to a correct input of a predetermined code through the electrical input means indicated generally at 50. In the exemplary embodiment, such electrically driven means are indicated generally at 80 in FIGS. 6 through 8 and include a reversible electric motor 81 which is connected by suitable electrical wiring 82 to the code input means, indicated generally at 50, and its associated batteries 57 as shown schematically in FIG. 10. A motor control and timing means 83 is provided in the circuit for controlling operation of the motor as subsequently described.

Figure 5:
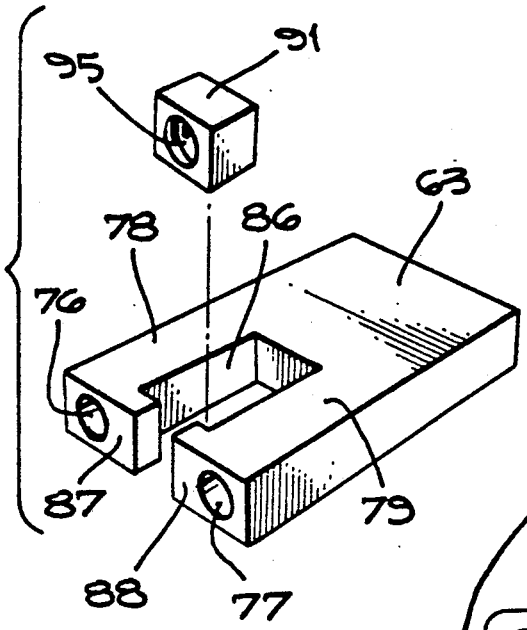
FIG. 5 is a detailed exploded view of a preferred exemplary embodiment of the lock bolt and follower block employed in the lost motion connection between the lock bolt and the electrically driven motor means of the preferred exemplary embodiment of a self-locking electronic lock.

As particularly contemplated within the present invention, a lost motion connection, indicated generally at 85, is provided between bolt 63 and motor 81 for selectively driving and releasing bolt 63, as will now be described. As best seen in FIG. 5, bolt 63 has a slot 86 formed between legs 78 and 79 with inturned foot portions 87 and 88 providing outer stop surfaces 89 and 90 for slide 86, as best seen in FIG. 7. A slide block 91 is provided to fit within slide 86 and be moved forwardly and backwardly therein by operation of the threaded shaft 92, connected to motor shaft 93 by coupling 94 as seen in FIGS. 7 and 8, the block 91 having an internal thread 95 adapted to mate with the external thread 96 on shaft 92.

Upon entry of a predetermined combination via the push pads, indicated generally at 55, the printed circuit board 56, in association with its power source of batteries 57*a* and 57*b*, produces an output signal communicated via electrical lines 82 to motor 81 to operate the motor to rotate the shaft 92 in a first given direction to withdraw the slide block 91 inwardly of housing 61 sufficiently to withdraw bolt 63 from gate 64 as seen in FIG. 6. Suitable electronic motor control and timing means 83 may be provided, as known in the art, to provide for a first timed operation of motor 81 in a first direction of rotation to withdraw bolt 63, then provide a second timed dwell therefor while the motor remains stationary, and thereafter a third timed motor operation wherein motor 81 is reversed and driven in a reverse direction to return the slide block 91 via its lost motion connection to the position of FIG. 7. If the safe door is opened during the dwell period by rotating handle 11 a quarter turn in a clockwise direction, as seen in FIG. 1, the bolt works including link 23 will be moved to open the safe door and place the inner edge 25 in alignment with the bolt 63, as seen in FIG. 7. Following the dwell period, when the slide block 91 is returned to its lock bolt release position as seen in FIG. 7, the bolt 63 is held in its released position, under the bias of springs 72 and 73, against surface 25 of link 23 awaiting closing of the door for automatic locking thereof.

When the "lost motion" connection between the electric motor 81 and bolt 63 is operated by the motor control means 83 to the position in FIG. 7, slide block 91 having been moved away from the stop shoulders 89 and 90, the bolt is ready to automatically lock the safe door bolt works upon closing of the door. Referring to FIGS. 7 and 8, when the safe door is closed and the door handle 11 is rotated a quarter turn in a counterclockwise direction back to the position illustrated in FIG. 1, the link will be shifted downwardly in FIG. 7 relative to bolt 63 such that gate 64 will come into alignment with bolt 63 and the bolt will automatically shift into the bolt works locking position of FIG. 8 under the urging of its bias provided by springs 72 and 73. The bolt works of the safe door are thus automatically locked by the associated electronic lock of the present invention when the door is closed and the bolt works thrown into a door locking position. It is not necessary to turn a locked dial or manipulate an electronic code input means in any manner to cause this automatic locking of the safe door when the door is closed and the handle is moved into its normal door locking position.

Additionally contemplated within the present invention is a blocking means to prevent unauthorized withdrawal of the lock bolt 63. The blocking means consists of a leaf spring, indicated generally at 100 in FIG. 14, having a stop surface 102 normally biased in a blocking position relative to bolt 63 and which contacts the trailing edges 104 and 105 of the bolt 63 when inward pressure is applied to the bolt 63. This stop surface 102 impedes inward motion of the bolt 63, keeping bolt 63 in the normally biased position within linkage gate 64. Upon operation of the "lost motion" connection between electric motor 81 and bolt 63, a releasing means, including chamfered edge 106 of slide block 91 and engagement surface 101 on a tab, indicated generally at 103, which is integral with leaf spring 100, enables authorized movement of the bolt 63. As shown in FIG. 16, the chamfered edge 106 of slide block 91 contacts the engagement surface 101, deflecting the engagement surface 101 and displacing the stop surface 102 from alignment with trailing edges 104 and 105. The bolt 63 is then released to enable authorized inward movement, unimpeded by the leaf spring 100. When the bolt 63 has returned to the biased position, the leaf spring 100 also returns to its biased position with the stop surface 102 relatively aligned with the trailing edges 104 and 105 of the bolt 63.

An alternative preferred embodiment of an exemplary blocking means is shown in FIGS. 21 through 24. The alternative blocking means consists of a stamped metal leaf spring 161, having left and right side tongues 164 and 165 normally biased into blocking positions relative to bolt 63 and which contacts the trailing edges 104 and 105 of the bolt when inward pressure is applied to the bolt 63. These tongues 164 and 165 impede inward motion of the bolt 63, keeping bolt 63 in the normally biased position within linkage gate 64. Additionally, a rounded deflection surface 166 is provided integral to leaf spring, and positioned relative to the chamfered edge 167 of slide block 91. Leaf spring 161 is rigidly mounted inside the lock housing 61 such that deflection surface 166 and left and right side tongues 164 and 165 depend from the plane of the spring 161.

As best seen in FIG. 24, upon operation of the "lost motion" connection between electric motor 81 and bolt 63, chamfered edge 167 of slide block 91 contacts deflection surface 166, causing it to deflect against its bias, and displacing left and right side tongues 164 and 165 from alignment with trailing edge, 104 and 105. The bolt 63 is then released to enable authorized inward movement, unimpeded by the leaf spring 161. When the bolt 63 has returned to the biased position, leaf spring 161 also returns to its biased position with left and right side tongues 164 and 165 relatively aligned with the trailing edges 104 and 105 of the bolt 63, as shown in FIG. 23.

Alternatively, a single spring can be provided between the end of the motor shaft 92 and an appropriate bore provided in the facing inner end wall of the bolt slot 86. Such single spring would be captive within the slot 86, simply and easily assembled and reliable under extended use.

Referring to FIGS. 18 through 20, the present invention can be adapted for use in a human passage security door. In FIG. 19, an exemplary human passage security door 130 is illustrated as having a fixed manual handle 131 and an electronic combination code entry device 132 on the outer, front side of the door, and a door locking bolt mechanism, indicated generally at 140, mounted in an interior, nonaccessible cavity 137 within the security door 130. The door locking bolt mechanism 140 includes a lock housing 144 normally enclosed by a cover plate 145, and is provided with a central web 146 which is integral with webs 147 and 148 which provide a slide way 149 for bolt 141. Bolt 141 is biased by springs 72 and 73 to normally extend outwardly of slide way 149 and housing 144, and the bolt mechanism 140 is mounted such that bolt 141 protrudes from the edge of security door 130 when the bolt 141 is in its normally biased position. A standard face plate 134 seals the cavity within which the door locking bolt mechanism 140 operates as hereinafter described. The door jamb 133 provides a receptacle 136 which receives the door bolt 141 when the security door is in the closed and locked position. A standard jamb plate 135 seals the door jamb receptacle 136.

Electrically driven means are provided for withdrawing bolt 141 against its bias, and include a reversible electric motor 81, a circuit board 143 and the electronic combination code entry device 132. In the preferred exemplary embodiment, the circuit board 143 is mounted within the lock housing 144 for security. Upon entry of a predetermined code into the electronic combination code entry device 132, an output signal is communicated to motor 81 to operate the motor to rotate the shaft 92 in a first given direction to withdraw the slide block 91 inwardly sufficient to withdraw bolt 141 from door jamb receptacle 136, as seen in FIG. 19. Circuit board 143 supplies electronic motor control and timing means 83, as known in the art, to provide for a first timed operation of motor 81 in a first direction of rotation to withdraw bolt 141, then provide a second timed dwell while the motor remains stationary and thereafter a third timed motor operation wherein motor 81 is reversed and driven in a reverse direction to return the slide block 91 via its lost motion connection to the phantom position illustrated in FIG. 19. During the dwell period, the operator is free to open the security door by pulling on the fixed handle 131. After the third motor operation, the bolt 141 returns to the fully protracted position, under the bias of springs 72 and 73. The bolt 141 has a camming surface 142 which cooperates on contact with the door jamb plate 135 to deflect and retract bolt 141 against its bias, until the security door 130 is fully closed, whereupon the bolt 141 returns to its normally biased position within the door jamb receptacle 136. The operation of the lost motion connection between the bolt 141 and motor 81 in the door locking bolt mechanism 140 is substantially similar to the aforementioned operation of the self locking electronic lock 60, with the exception that a blocking and releasing means 100 is unnecessary.

It has been observed that an electric motor controlled bolt has significant advantages over a solenoid operated bolt. First of all, in battery powered locks as are contemplated in the present invention, energy saving is important to extend the useful life of the lock between battery replacements. An electric motor of the type contemplated by the present invention uses substantially less power to bring the bolt to the retracted position than that required to actuate a similarly situated solenoid operated lock. A secondary advantage is that of enhanced security. Solenoid locks can be easily defeated by unauthorized inward urging of the solenoid armature against its internal bias. To prevent such unauthorized movement, solenoid operated locks use a system of tabs and retainer lips. However, these precautionary steps add to the cost and complication of manufacture of solenoid operated locks. Motor controlled bolts, as in the present invention, cannot be urged inward by unauthorized external movement, and thus are both more secure and easier to manufacture.

Having thus described a preferred exemplary embodiment of the self-locking electronic lock for use with a safe door having manually operable bolt works in accordance with the present invention, it should now be apparent to those skilled in the art that the various advantages and objects aforestated for the present invention have been attained. Furthermore, it should be apparent to those skilled in the art that various modifications, adaptations and alternative embodiments thereof may be made within the scope of the present invention which is defined by the following claims.

We claim:

1. A self locking electronic lock for use with a safe door having manually operated bolt works including a door handle, linkage operated by said handle and door bolts operated by said linkage, said linkage having a lock bolt receiving gate whereby said linkage is immobilized when a lock bolt is received in said gate to thereby lock said safe door, said electronic lock comprising:

a biased lock bolt and mounting means for mounting said lock bolt relative said linkage whereby said bolt is normally biased into said linkage gate when aligned thereto in a linkage locking position and biased against said linkage when not aligned to said gate, in a linkage engaging position whereby manipulation of said linkage by said handle to align said gate to said lock bolt causes said lock bolt to automatically enter said gate due to its bias toward such linkage locking position; and blocking means for normally blocking withdrawal of said bolt from said linkage gate after said bolt has entered said gate.

2. The self locking electronic lock of claim 1 wherein said lock further comprises:

electrically driven means for withdrawing said lock bolt against its bias from said gate on actuation thereof and for thereafter releasing said lock bolt whereby said lock bolt may assume its linkage engaging position if said linkage has been manipulated to move said gate out of alignment with said lock bolt when said lock bolt has been withdrawn therefrom by said electrically driven means, said electrically driven means including release means for releasing said blocking means as it operates to withdraw said bolt.

3. The self locking electronic lock of claim 2 wherein said electrically driven means further comprises:

a lost motion connection with said lock bolt whereby said electrically driven means is operable between a lock bolt withdrawn position and lock bolt released position and said lock bolt may remain in a lock bolt withdrawn position engaging against said linkage when said electrically driven means assumes said lock bolt released position following operation thereof to said lock bolt withdrawn position and said linkage has been manipulated to move said gate out of alignment with said lock bolt;

and said blocking means comprises a leaf spring having a stop surface normally biased into a blocking position relative said lock bolt when it is in said lock bolt released position.

4. The self locking electronic lock of claim 3 wherein said electrically driven means further comprises:

a reversible electric motor having a rotor shaft extending therefrom, said shaft being provided with a threaded portion thereon to engage with said lost motion connection with said lock bolt; and said blocking means includes an engagement surface adapted to be engaged by a part of said lost motion connection to displace said stop surface from said lock bolt blocking position on operation of said lost motion connection to release said lock bolt.

5. The self locking electronic lock of claim 4 wherein said lost motion connection with said lock bolt comprises:

a slot in said lock bolt and a slide block located in said slot, said block having a threaded bore receiving said rotor shaft, to be moveable in said slot on operation of said motor, said slot having at least one block abutment surface whereby said lock bolt is moved to its withdrawn position by movement of said slide block when said block abuts said surface and releases said lock bolt when moved in said slot away from said abutment surface; and said engagement surface is provided on a tab integral with said leaf spring and said part of said lost motion connection comprises said slide block which is provided to engage said tab to displace said stop surface from said lock bolt blocking position by said movement of said slide block.

6. An electrically operated lock having a housing and comprising:

a spring biased bolt and mounting means for mounting said bolt to said housing for movement inward and outward of said housing, said bolt being normally biased outwardly of said housing;

an electric motor and connecting means between said motor and bolt for moving said bolt inwardly of said housing against its bias by operation of said motor;

electrical means for selectively operating said motor to move said bolt via said connecting means; and blocking means for normally blocking inward movement of said bolt after it has moved outward under its bias to impede unauthorized movement of said bolt; and release means associated with said connecting means and said blocking means to cause said blocking means to release said bolt for authorized inward movement of said bolt when said electrical means selectively operates said motor and connecting means.

7. The electrically operated lock of claim 6 wherein said connecting means comprises:

a lost motion connection between said motor and bolt whereby said bolt is selectively moveable independently of said motor; and said blocking means comprises a blocking spring member having a stop surface normally biased into a blocking position relative inward movement of said bolt until displaced by deflection of said member.

8. The electrically operated lock of claim 7 wherein:

said motor is a reversible motor having a reversible rotor shaft;

said connecting means includes a slide block and means for providing a lost motion connection between said block and said bolt, said having a drive thread connection to said shaft whereby selective rotation of said shaft causes selective movement of said block relative said bolt;

spring mounting means are provided to position said blocking spring member to be deflected by said slide block as said slide block is moved relative said spring member.

9. The electrically operated lock of claim 6 wherein said electrical means comprises:

a lock combination entry means for receiving entry of a predetermined lock opening combination and a signal generating means operated by said entry means for sending a motor operating signal to said motor to move said bolt when said predetermined combination is entered on said entry means wherein said signal generating means is provided to first operate said motor in a first bolt withdrawal mode to cause movement of said bolt inwardly of said housing, then in a second mode wherein said motor is in a dwell condition and then in third mode wherein said motor is reversed;

said connecting means includes a lost motion connection between said motor and bolt whereby said bolt is movable independently to said motor when said motor has been operated in said third mode; and said blocking means comprises a blocking spring member having a stop surface normally biased into a blocking position relative inward movement of said bolt until displaced by deflection of said member.

10. The electronic lock of claim 6 wherein said blocking means further comprises:

a stamped metal spring plate having a deflection surface normally positioned to engage a part of said lost motion connection and a left and a right side tongue normally biased in a blocking position relative said bolt;

whereby upon operation of said lost motion connection to release said bolt, said deflection surface is deflected by contact with said lost motion connection and said left and right side tongues are displaced from said bolt blocking position.

11. The electronic lock of claim 10 wherein:

said blocking means spring plate is rigidly mounted to a mounting surface within said lock housing; and said deflection surface and said left and right side tongues depend from the plane of said mounting surface.

12. A self locking electronic lock system for use with safe doors having a door locking bolt works manipulated between door open and door locked positions by a door mounted handle, said lock system comprising:

an electronic lock combination entry means for receiving a predetermined lock opening combination and signal generating means for generating an electrical signal when said lock opening combination is entered;

a lock bolt and means for mounting said lock bolt for movement into and out of a bolt works locking position;

electric motor means operable by said signal and connecting means between said motor and bolt for moving said bolt on operation of said motor; and blocking means for normally blocking unauthorized movement of said lock bolt out of said bolt works locking position, said blocking means being operable to allow movement of said lock bolt out of said bolt works locking position only when said electric motor means is operated by said signal and said connecting means is operated to move said bolt.

13. The electronic lock system of claim 12 wherein said connecting means includes a lost motion connection between said motor and lock bolt;

biasing means are provided for biasing said lock bolt toward said bolt works locking position; and said blocking means comprise a blocking spring member having a stop surface normally biased into a blocking position relative inward movement of said bolt until displaced by deflection of said member.

14. The electronic lock system of claim 13 wherein said bolt works includes a lock bolt receiving gate provided in a bolt engaging surface;

said means for mounting said lock bolt mounts said bolt to be normally biased against said bolt engaging surface when said bolt works is in a door open position and automatically into said gate when said bolt works is manipulated to said door locked position; and said blocking means operates automatically to block withdrawal movement of said bolt relative said gate when said bolt works is manipulated to said door locked position and said bolt automatically enters said gate.

15. An electronic door lock for use with a human passage door having a spring biased cam bolt which deflects inwardly of the door on closing of the door relative an associated door jamb and which moves under its spring bias into a bolt receiving receptacle in the jamb when the door is in its closed position, said electronic door lock comprising:

electrical motor means for withdrawing said cam bolt against its bias inwardly of said door and out of said receptacle on actuation thereof;

an electronic code entry means on an accessible side of said door for manual entry of a predetermined code; and circuit board means electrically connected to said code entry means and to said electrical motor means for actuating said motor means to withdraw said cam bolt from said receptacle upon entry of said predetermined code via said code entry means.

16. The electronic door lock of claim 15 wherein said electrical motor means for withdrawing said cam bolt comprises:

a reversible electric motor having a threaded motor driven shaft engaging said cam bolt whereby rotation of said motor in a first direction withdraws said cam bolt and rotation in a second direction releases said cam bolt.

17. The electronic door lock of claim 16 wherein:

a lost motion connection is provided between said motor driven shaft and said bolt whereby said cam bolt is free to move inwardly and outwardly of said door when said motor is rotated in said second direction to release said bolt.

18. The electronic door lock of claim 16 wherein said circuit board means is provided so as to rotate said motor in said first direction and then in said second direction upon a single entry of said predetermined code.

19. An electrically operated spring bolt lock for controlled access door having a fixed handle which is not connected to said bolt, comprising:

a cam bolt and means for mounting it in said door for movement inwardly and outwardly of said door;

spring means for normally biasing said bolt outwardly of said door;

electrically driven means for moving said bolt inwardly of said door against the bias of said spring means for a given time interval to allow opening of said door by said fixed handle and for releasing said bolt after the expiration of said time interval; and code entry means for actuating said electrically driven means upon entry therein of a predetermined code.

20. The electrically operated spring bolt lock of claim 19 wherein said electrically driven means comprises:

a lost motion connection with said cam bolt whereby said cam bolt is moveable inwardly of said door to allow closing of said door when released by said electrically driven means.

21. The electrically operated spring bolt lock of claim 20 wherein said electrically driven means further comprises:

a reversible electric motor having a motor shaft connected via said lost motion connection with said cam bolt whereby rotation of said motor in a first direction withdraws said bolt inwardly of said door and subsequent reverse rotation in a second direction releases said bolt to be free to move under its spring bias inwardly and outwardly of said door as said door is closed against an associated door jamb.

22. The electrically operated spring bolt lock of claim 19 wherein:

means are provided for mounting said code entry means on an exterior accessible side of said door;

a lock housing is provided on an interior non-accessible side of said door; and mounting means are provided for mounting said electrically driven means, cam bolt and spring means within said housing, said cam bolt being moveable to protrude from said housing and door.

23. An automatically operated electronically controlled door unlocking and locking system comprising:

a bolt having a cam end face and means for mounting said bolt for movement inwardly and outwardly of said door with said cam end face opposing an adjacent door jamb as said door is closed;

spring biasing means for biasing said bolt outwardly of said door, while allowing deflective movement of said bolt inwardly of said door as it is closed relative said jamb, whereby said bolt is receivable in a receptacle in said jamb;

an electric motor and connecting means between said motor and bolt for moving said bolt inwardly of said door against its bias by operation of said motor to a bolt withdrawn position and for releasing said bolt to a bolt protracted position; and electrical means, including a code entry means for entry of a predetermined code, for operating said motor to initially withdraw said bolt inwardly of said door on entry of said code to allow opening of said door and automatically, subsequent thereof, to release said bolt.

24. The automatically operated electrically controlled door unlocking and locking system of claim 23 wherein said door is provided with a fixed handle and said connecting means comprises:

a lost motion connection between said motor and said bolt whereby operation of said bolt independently of said motor is available as said door is being closed and said bolt deflects past said door jamb and said door may be opened by pulling on said fixed handle when said bolt is withdrawn by operation of said electrical means.

25. The electrically operated spring bolt lock of claim 24 wherein a housing is provided interiorly of said door and in which said bolt and means for mounting said bolt are provided and said electrical means comprises:

means for mounting said code entry means on an exterior, accessible side of said door;

circuit board means providing electrical circuitry to operate said motor upon entry of said predetermined code; and means for mounting said circuit board within said housing.

* * * * *